US010113523B2

(12) United States Patent
Etlender et al.

(10) Patent No.: US 10,113,523 B2
(45) **Date of Patent: *Oct. 30, 2018**

(54) INJECTOR

(71) Applicant: Continental Automotive GmbH, Hannover (DE)

(72) Inventors: Roman Etlender, Regensburg (DE); Werner Reim, Regensburg (DE); Willibald Schuerz, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 59 days.

This patent is subject to a terminal disclaimer.

(21) Appl. No.: 14/897,829

(22) PCT Filed: May 22, 2014

(86) PCT No.: PCT/EP2014/060535
§ 371 (c)(1),
(2) Date: Dec. 11, 2015

(87) PCT Pub. No.: WO2014/198510
PCT Pub. Date: Dec. 18, 2014

(65) Prior Publication Data

US 2016/0146172 A1 May 26, 2016

(30) Foreign Application Priority Data

Jun. 11, 2013 (DE) ..... 10 2013 210 843

(51) Int. Cl.
*F02M 51/00* (2006.01)
*F02M 61/16* (2006.01)
(Continued)

(52) U.S. Cl.
CPC ..... *F02M 61/167* (2013.01); *F02M 51/0603* (2013.01); *F02M 61/04* (2013.01);
(Continued)

(58) Field of Classification Search
CPC ..... F02D 41/20; F02M 69/462; F02M 35/10216; F02M 51/061
(Continued)

(56) References Cited

U.S. PATENT DOCUMENTS 7,258,283 B2 * 8/2007 Heinz ..... F02M 51/0603 239/102.2
7,290,530 B2 * 11/2007 Boecking ..... F02M 47/027 123/467
(Continued)

FOREIGN PATENT DOCUMENTS

DE 10219149 A1 11/2003 ..... F02M 47/02
DE 10333427 B3 8/2004 ..... F02M 47/02
(Continued)

OTHER PUBLICATIONS

German Office Action, Application No. 102013210843.5, 5 pages, dated Dec. 10, 2013.
(Continued)

*Primary Examiner* — John Kwon
(74) *Attorney, Agent, or Firm* — Slayden Grubert Beard PLLC

(57) ABSTRACT

An injector includes an actuator arranged in an actuator space, a piston guide having a bore hole, and a piston arranged in the bore hole. The piston has a first end face facing the actuator and delimiting a first space in and/or on the bore hole, and a second end face lying opposite the first space and delimiting an adjoining second space in and/or on the bore hole. The piston is arranged between the first and second spaces, and a gap extends around the circumference of the piston between the piston and the bore hole. The piston includes a first material and the piston guide includes a second material, the first and second materials having different thermal expansion properties such that when the piston guide and/or piston are heated, the gap width of the
(Continued)

gap decreases to limit fuel leakage between the first space and second spaces.

20 Claims, 4 Drawing Sheets

(51) Int. Cl.
*F02M 51/06* (2006.01)
*F02M 61/04* (2006.01)
*F02M 63/00* (2006.01)
*F02M 63/02* (2006.01)

(52) U.S. Cl.
CPC ..... *F02M 61/166* (2013.01); *F02M 63/0026* (2013.01); *F02M 63/0033* (2013.01); *F02M 63/0225* (2013.01); *F02M 2200/705* (2013.01); *F02M 2200/90* (2013.01)

(58) Field of Classification Search
USPC ..... 123/490, 445, 446, 472, 478, 480, 468; 239/585.1; 361/154, 155
See application file for complete search history.

(56) References Cited

U.S. PATENT DOCUMENTS

2002/0121713 A1* 9/2002 Moss ..... B29C 45/27 264/40.7
2003/0038258 A1* 2/2003 Stoecklein ..... F02M 47/027 251/57
2009/0065614 A1* 3/2009 Ganser ..... F02M 47/025 239/584
2009/0241650 A1* 10/2009 Kondo ..... F02M 47/027 73/114.43
2010/0006675 A1* 1/2010 Boecking ..... F02M 51/0603 239/533.2
2010/0294242 A1* 11/2010 Kondo ..... F02M 47/027 123/470
2012/0152206 A1* 6/2012 Adachi ..... F02M 47/027 123/445
2014/0251276 A1* 9/2014 Schurz ..... F02M 51/0603 123/456
2015/0184627 A1* 7/2015 Schuerz ..... F02M 63/0026 123/478
2015/0211456 A1* 7/2015 Schuerz ..... F02M 51/0603 123/472
2015/0292462 A1* 10/2015 Jagani ..... F02M 63/0026 239/102.2
2015/0345443 A1* 12/2015 Schuerz ..... F02M 51/0603 239/102.2

FOREIGN PATENT DOCUMENTS

EP 0477400 B1 4/2000 ..... F02M 51/06
EP 1970556 A1 9/2008 ..... F02M 47/02
EP 2439397 A2 4/2012 ..... F02M 47/02
WO 90/07070 A1 6/1990 ..... A47C 29/00
WO 2014/198510 A1 12/2014 ..... F02M 61/16

OTHER PUBLICATIONS

International Search Report and Written Opinion, Application No. PCT/EP2014/060535, 16 pages, dated Jul. 31, 2014.
Chinese Office Action, Application No. 201480045346.1, 12 pages, dated May 15, 2017.

* cited by examiner

INJECTOR

CROSS-REFERENCE TO RELATED APPLICATIONS

This application is a U.S. National Stage Application of International Application No. PCT/EP2014/060535 filed May 22, 2014, which designates the United States of America, and claims priority to DE Application No. 10 2013 210 843.5 filed Jun. 11, 2013, the contents of which are hereby incorporated by reference in their entirety.

TECHNICAL FIELD

The invention relates to an injector having an actuator chamber in which an actuator is arranged, a control plate in which a control piston bore is provided, a control piston which is arranged in the control piston bore of the control plate, wherein the control piston has a first face side facing toward the actuator, wherein a section of the control piston bore delimited by the first face side forms a control chamber, wherein a section of the control piston bore situated opposite the control chamber forms a spring chamber, wherein the control piston is arranged between the control chamber and the spring chamber, wherein, at the circumference of the control piston, a gap with a gap width is provided between the control piston and the control piston bore.

BACKGROUND

For the injection of fuel into internal combustion engines, use is made inter alia of direct fuel injection. For this purpose, use is made of piezo injectors, the nozzle needle of which is driven by way of a piezo actuator. Here, virtually clearance-free coupling between the piezo actuator and nozzle needle is necessary, though this is difficult to maintain owing to thermal changes in length in the piezo injector. To eliminate this problem, the nozzle needle is coupled hydraulically to the piezo actuator. For this purpose, the piezo injector has an actuator chamber in which the piezo actuator is arranged. A control piston is arranged in a control piston bore. The control piston has a first face side facing toward the piezo actuator. A section of the control piston bore delimited by the first face side forms a first control chamber. A section of the control piston bore situated opposite the first control chamber forms a spring chamber. The control piston is arranged between the first control chamber and the spring chamber. A nozzle needle has a second face side. The nozzle needle guides a nozzle needle sleeve, wherein the nozzle needle sleeve and the second face side delimit a second control chamber. Furthermore, a connecting bore is provided between the first control chamber and the second control chamber. A leakage pin, which is arranged between the piezo actuator and the first face side and in a leakage pin bore, effects coupling of the piezo actuator and of the control piston. If the piezo actuator is actuated, the leakage pin presses against the control piston and displaces the latter in the direction of the nozzle needle.

Owing to the pressure difference between the control chamber and the spring chamber, a fluid flow takes place laterally through a gap between the control piston and the control piston plate. Here, the fluid flow is dependent on the gap width and the temperature of the fuel. Owing to the great temperature differences during the operation of the injector with cold and hot fuels and with a cold and hot internal combustion engine, the fluid flow changes in a manner dependent on the temperature of the injector and of the fuel. This can lead to changed operating characteristics.

SUMMARY

One embodiment provides an injector having an actuator chamber in which an actuator is arranged, a piston guide in which a bore is provided, a piston which is arranged in the bore of the piston guide, wherein the piston has a first face side facing toward the actuator, wherein the piston, by way of the first face side, delimits a first chamber which is arranged in and/or at the bore, wherein the piston, by way of a second face side situated opposite the first chamber, delimits a second chamber which is adjacent in and/or at the bore, wherein the piston is arranged between the first chamber and the second chamber, wherein, at the circumference of the piston, a gap with a gap width is provided between the piston and the bore, wherein the piston has a first material and the piston guide has a second material, wherein the first material, when warmed up, exhibits first thermal expansion, and the second material, when warmed up, exhibits second thermal expansion which differs from the first thermal expansion, and wherein the first material is selected relative to the second material such that, when the piston guide and/or the piston are/is warmed up, the gap width of the gap decreases in order to limit fuel leakage between the first chamber and the second chamber.

In a further embodiment, the first material and the second material are selected such that, when the piston guide and/or the piston are/is warmed up, leakage of the fuel through the gap is substantially constant over the course of the warming-up of the piston guide and/or of the piston.

In a further embodiment, the first material has a first coefficient of thermal expansion and the second material has a second coefficient of thermal expansion, wherein the first material and the second material are selected such that the first coefficient of thermal expansion is lower than the second coefficient of thermal expansion.

In a further embodiment, the first material has a first coefficient of thermal expansion and the second material has a second coefficient of thermal expansion, wherein the two materials are selected such that the two coefficients of thermal expansion have a difference of 3 to $12 \cdot 10^{-6}$ $K^{-1}$, in particular 5 to $10 \cdot 10^{-6}$ $K^{-1}$.

In a further embodiment, the first material has a first coefficient of thermal expansion of 5 to $25 \cdot 10^{-6}$ $K^{-1}$ and the second material has a second coefficient of thermal expansion of 10 to $30 \cdot 10^{-6}$ $K^{-1}$.

In a further embodiment, one of the two materials is hard metal, in particular in a composition having at least 70 percent, preferably at least 90, tungsten carbide and 1 to 30 percent, preferably 1 to 10 percent, cobalt or nickel-chromium or nickel-chromium-cobalt, and the other of the two materials is steel, in particular an unalloyed steel or low-alloy steel.

In a further embodiment, one of the two materials has titanium, in particular at least 50 percent, preferably 80 percent titanium, and the other of the two materials has a steel which comprises at least one of the following metals: chromium, nickel, manganese, copper.

In a further embodiment, one of the two materials has steel with a coefficient of thermal expansion of 12 to $16 \cdot 10^{6}$ $K^{1}$ and the other of the two materials has a manganese steel, in particular MnNi10Cu18 or MnNi16Cu10.

In a further embodiment, the piston guide is a control plate or a leakage pin bore or a nozzle needle sleeve, and in that the piston, correspondingly to the piston guide, is a control piston or a leakage pin or a nozzle needle.

In a further embodiment, the actuator chamber is a piezo actuator.

BRIEF DESCRIPTION OF THE DRAWINGS

Example embodiments of the invention are described in detail below with reference to the drawings, in which.

DETAILED DESCRIPTION

Figure 1:
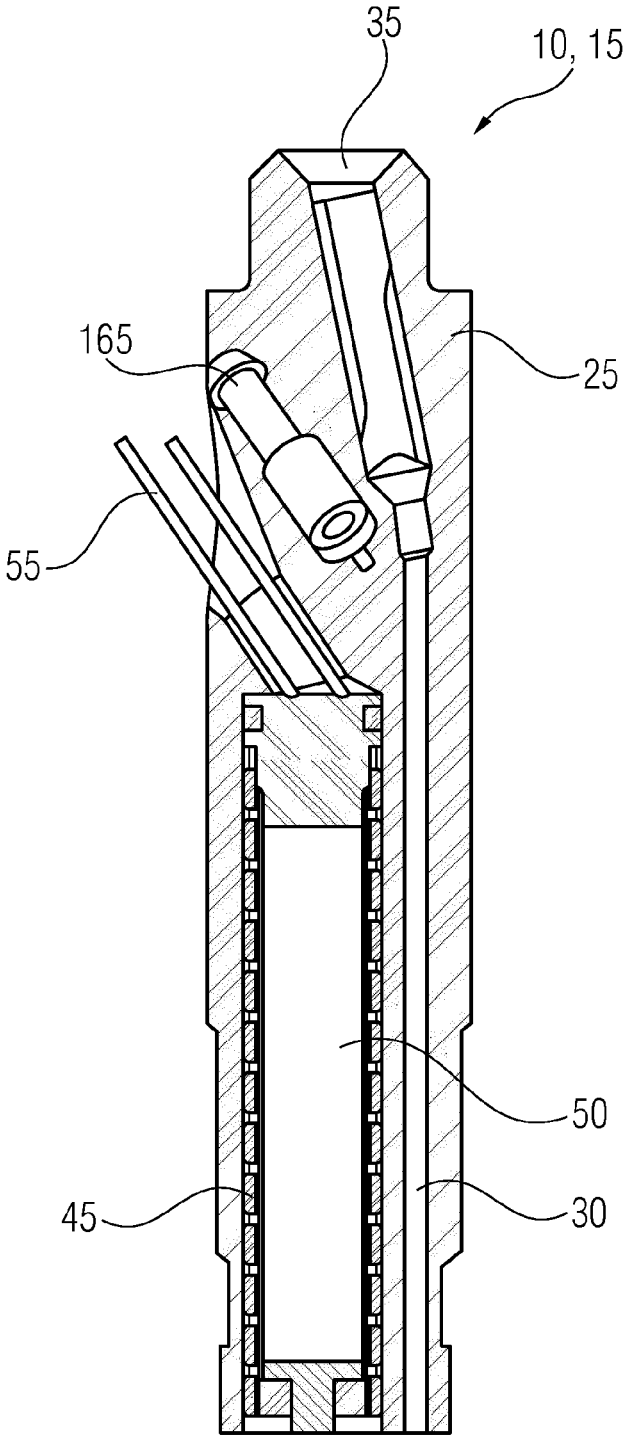
FIG. 1 shows a sectional view of an upper part of an injector.

Some embodiments of the invention provide an injector including an actuator chamber in which an actuator is arranged, a piston guide in which a bore is provided, and a piston which is arranged in the bore of the piston guide. The piston has a first face side facing toward the actuator. The piston, by way of the first face side, delimits a first chamber which is arranged in and/or at the bore. The piston, by way of a second face side situated opposite the first chamber, delimits a second chamber which is adjacent in and/or at the bore, wherein the piston is arranged between the first chamber and the second chamber. At the circumference of the piston, a gap with a gap width is provided between the piston and the bore. The piston has a first material and the piston guide has a second material, wherein the first material, when warmed up, exhibits first thermal expansion, and the second material, when warmed up, exhibits second thermal expansion which differs from the first thermal expansion. The first material is selected relative to the second material such that, when the piston guide and/or the piston are/is warmed up, the gap width of the gap decreases in order to limit fuel leakage between the first chamber and the second chamber.

This configuration has the advantage that, when the fuel and/or the injector are/is warmed up, the fuel leakage flow between the first chamber and the second chamber is reduced owing to the decreasing gap width. In this way, the injector exhibits improved operating characteristics, and can be actuated in a more precise and targeted manner. At the same time, the gap width can be adapted in targeted fashion to the lubrication characteristics of the fuel in an improved manner.

In a further embodiment, the first material and the second material are selected such that, when the piston guide and/or the piston are/is warmed up, leakage of the fuel through the gap is substantially constant over the course of the warming-up of the piston guide and/or of the piston. In this way, particularly stable operating characteristics and particularly good actuation characteristics of the injector are provided.

In a further embodiment, the first material has a first coefficient of thermal expansion and the second material has a second coefficient of thermal expansion, wherein the first material and the second material are selected such that the first coefficient of thermal expansion is lower than the second coefficient of thermal expansion. In this way, distortion of the piston guide within a housing of the injector is prevented, and at the same time, the gap width is reduced in the event of warming up.

It may be advantageous if the first material has a first coefficient of thermal expansion and the second material has a second coefficient of thermal expansion, wherein the two materials are selected such that the two coefficients of thermal expansion have a difference of 3 to $12 \cdot 10^{-6}$ $K^{-1}$, in particular 5 to $10 \cdot 10^{-6}$ $K^{-1}$.

It may be advantageous if the first material has a first coefficient of thermal expansion of 5 to $25 \cdot 10^{-6}$ $K^{-1}$ and the second material has a second coefficient of thermal expansion of 10 to $30 \cdot 10^{6}$ $K^{1}$.

It may be advantageous if one of the two materials is hard metal, in particular in a composition having at least 70 percent, preferably at least 90, tungsten carbide and 1 to 30 percent, preferably 1 to 10 percent, cobalt or nickel-chromium or nickel-chromium-cobalt, and the other of the two materials is steel, in particular an unalloyed steel or low-alloy steel.

It may be advantageous if one of the two materials has titanium, in particular at least 50 percent, preferably 80 percent titanium, and the other of the two materials has a steel which comprises at least one of the following metals: chromium, nickel, manganese, copper.

It may be advantageous if one of the two materials has steel with a coefficient of thermal expansion of 12 to $16 \cdot 10^{-6}$ $K^{-1}$ and the other of the two materials has a manganese steel, in particular MnNi10Cu18 or MnNi16Cu10.

In a further embodiment, the piston guide is a control plate or a leakage pin bore or a nozzle needle sleeve, and the piston, correspondingly to the piston guide, is a control piston or a leakage pin or a nozzle needle.

It may be advantageous if the actuator is a piezo actuator.

Figure 2:
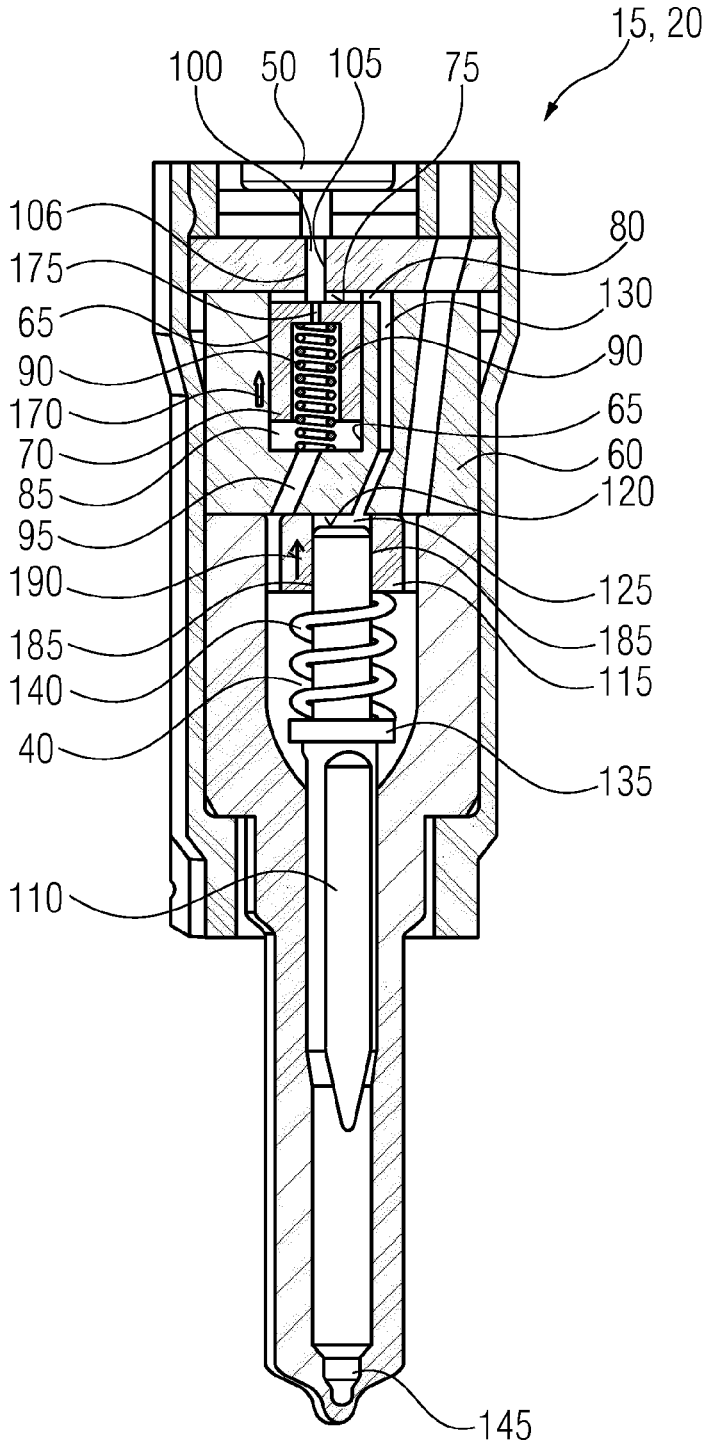
FIG. 2 shows a sectional view of a lower part of the injector.
Figure 3:
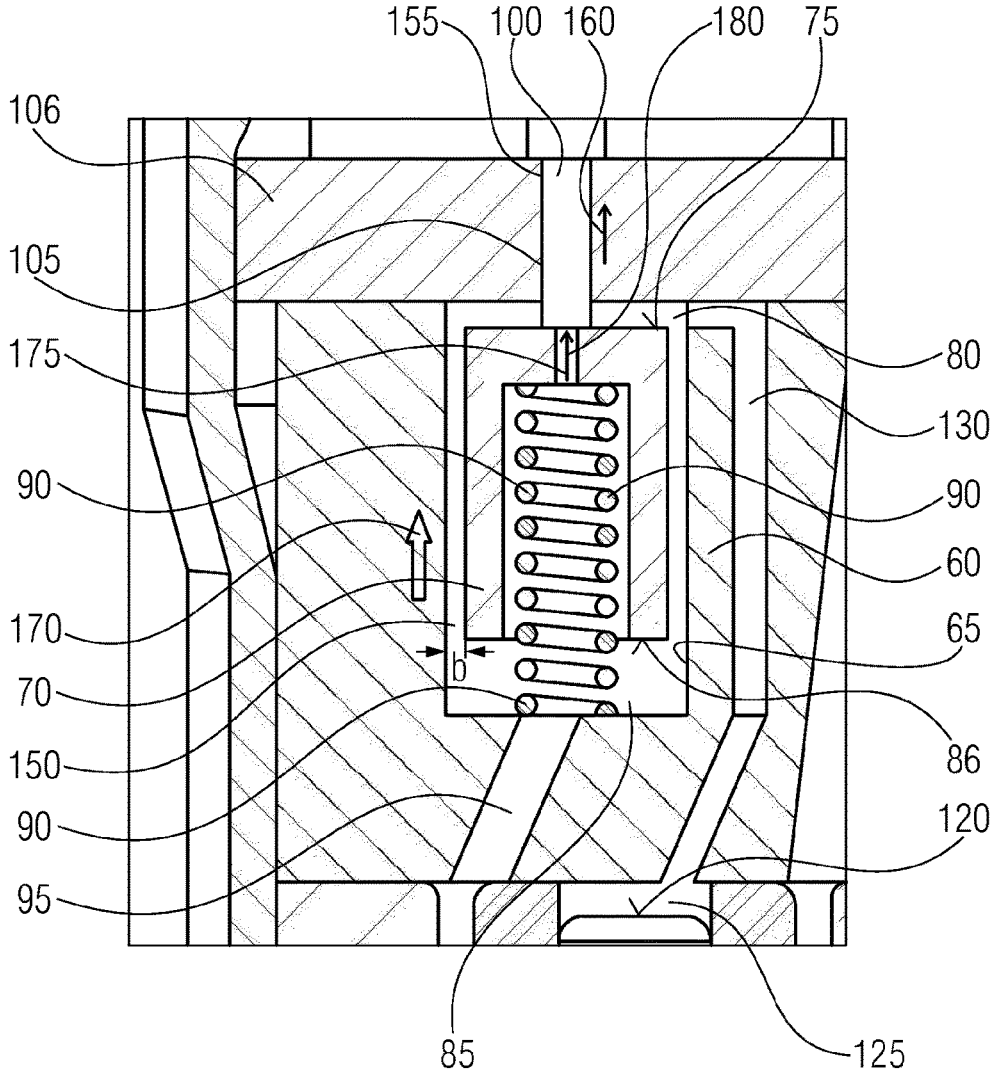
FIG. 3 shows an enlarged view of the sectional view of the injector shown in FIG. 2.
Figure 4:
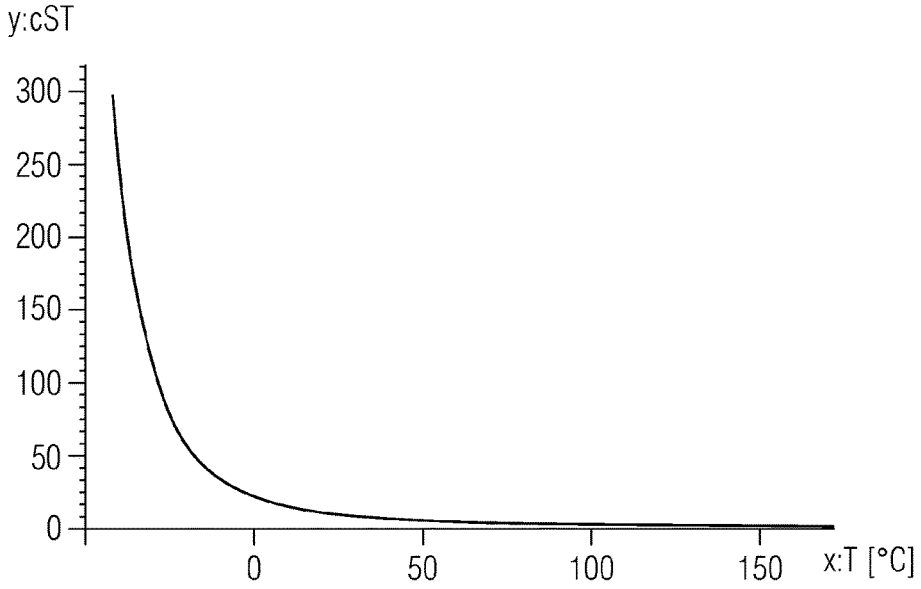
FIG. 4 shows a diagram of a kinetic viscosity of a fuel, plotted versus a temperature of the fuel.

FIG. 1 shows a sectional view of an upper part 10 of an injector 15. FIG. 2 shows a sectional view of a lower part 20 of the injector 15 shown in FIG. 1. FIG. 3 shows an enlarged sectional view of the injector 15 shown in FIG. 2. FIG. 4 shows a diagram of a kinetic viscosity cSt of a fuel, plotted versus a temperature T of the fuel. Below, FIGS. 1 to 4 will, for better understanding, be discussed jointly. The injector 15 is, in the embodiment, in the form of a piezo injector. The injector 15 may serve for the injection of fuel into an internal combustion engine, in particular for the injection of diesel fuel into a common-rail internal combustion engine.

The injector 15 has an injector housing 25. In the injector housing 25 there is provided a high-pressure bore 30. Furthermore, a high-pressure port 35 is provided at the top side on the injector housing 25, through which high-pressure port a pressurized fuel can be supplied into the high-pressure bore 30. The high-pressure bore 30 runs substantially in a longitudinal direction through the injector housing 25 as far as a high-pressure region 40 in the lower part 20 of the injector 15. Furthermore, the injector housing 25 has an actuator chamber 45 in the upper part 10 of the injector 15. An actuator 50 is arranged in the actuator chamber 45. In the embodiment, the actuator 50 in the form of a piezo actuator. Here, it is particularly advantageous for the piezo actuator to be in the form of a fully active piezo stack. Other actuators, in particular electrical actuators 50, are self-evidently also conceivable. The actuator 50 is of substantially cylindrical form and can be charged with an electrical voltage by way of an electrical terminal 55. If the electrical voltage is changed, a length of the actuator 50 in the longitudinal direction of the injector 15 can be varied.

In the lower part 20 (cf. FIGS. 2 and 3), the injector 15 has a control plate 60 in which a control piston bore 65 is arranged. Furthermore, a control piston 70 is arranged in the control piston bore 65. The control piston 70 has a first face side 75 pointing in the direction of the actuator 50. A section of the control piston bore 65 delimited by the first face side 75 forms a first control chamber 80. At that longitudinal end of the control piston 70 which is situated opposite the first control chamber 80, the control piston, by way of its second face side 86, forms a spring chamber 85 in the control piston bore 65. The control piston 70 is arranged in axially displaceable fashion between the first control chamber 80 and the spring chamber 85.

In the spring chamber 85 there is arranged a control piston spring 90 which, in the embodiment, is for example in the form of a helical compression spring. Here, a first longitudinal end of the control piston spring 90 is supported at the top side on the control piston 70 and at the bottom side on a face side of the control piston bore 65. Here, the control piston spring 90 acts on the control piston 70 with a force which acts in the longitudinal direction or in the direction of the first control chamber 80. The spring chamber 85 is connected by way of a high-pressure connection 95 to the high-pressure region 40. During the operation of the injector 15, the high-pressure region 40 is constantly flooded with fuel via the high-pressure bore 30. Furthermore, during the operation of the injector 15, the pressure which prevails in the high-pressure region 40 is present at all times in the spring chamber 85. Depending on the operating state, the fuel present in the high-pressure region 40 assumes different temperatures. The different temperatures T result in a different kinetic viscosity cSt of the fuel (cf. FIG. 4).

Between the actuator 50 and the control piston bore 65 there is provided a leakage pin 100. The leakage pin 100 is in this case dimensioned such that an increase in length of the actuator 50 is transmitted via the leakage pin 100 to the control piston 70. Here, the leakage pin 100 is arranged in a leakage pin bore 105 of a leakage pin plate 106, and forms a piston. The leakage pin bore 105 serves in this case as a (piston) guide of the leakage pin 100.

In the lower part 20 of the injector 15, the high-pressure bore 95 opens into the high-pressure region 40. Furthermore, a nozzle needle 110 is arranged in the high-pressure region 40. The nozzle needle 110 guides a nozzle needle sleeve 115, but itself forms a piston in the nozzle needle sleeve 115. A longitudinal end, pointing in the direction of the control piston plate 60, of the nozzle needle 110 has a face side 120. The face side 120 forms, together with the nozzle needle sleeve 115 and the control plate 60, a second control chamber 125. The second control chamber 125 is fluidically connected via a connecting bore 130 to the first control chamber 80.

The nozzle needle 110 has a circumferentially encircling collar 135. Between the collar 135 and the nozzle needle sleeve 115 there is arranged a nozzle needle spring 140. Here, the nozzle needle spring 140 is supported by way of a first longitudinal end on the nozzle needle sleeve 115 and by way of a second longitudinal end on the collar 135. Here, the nozzle needle spring 140 acts on the nozzle needle with a force directed away from the second control chamber 125 or a force directed away from the upper part 10.

In the closed state of the injector 15, the nozzle needle 110 bears against a lower tip 145 of the lower part 20 of the injector 15. Here, the actuator 50 is discharged, and is thus at its shortest length. In this state, no fuel is injected by way of the injector 15 into a combustion chamber of the internal combustion engine. This state is illustrated in FIGS. 1 to 3.

If the actuator 50 is charged with electrical energy via the electrical terminal 55, the length of the actuator 50 increases. Here, via the leakage pin 100, a force of the actuator 50 is transmitted to the control piston 70. As a result of the force, the control piston 70 is displaced in the control piston bore 65 in the direction of the nozzle needle 110. As a result, the volume of the first control chamber 80 increases, whereby the pressure in the first control chamber 80, and also in the second control chamber 125 which is coupled by the connecting bore 130, is reduced. As a result, owing to the reduced pressure in the second control chamber 125, a reduced force acts on the second face side 120 of the nozzle needle 110. In a lower region of the nozzle needle 110, the nozzle needle 110 continues to be acted on in the direction of the second control chamber 125 by the pressure of the high-pressure region 40. Owing to the pressure drop in the second control chamber 125 and the fact that the pressure at the lower end of the nozzle needle 110 remains constant, the nozzle needle 110 is lifted, and the injector 15 is opened, such that fuel is injected from the high-pressure region 40 into an internal combustion engine.

If the actuator 50 is subsequently deactivated and thus decreases in length, the high pressure prevailing in the spring chamber 85 and the force exerted on the control piston 70 by the control piston spring 90 effect a movement of the control piston 70 in the direction of the first control chamber 80. As a result, the pressure in the first control chamber 80, and also in the second control chamber 125 owing to the connecting bore 130 that exists between the first control chamber 80 and the second control chamber 125, is increased. Owing to the elevated pressure in the second control chamber 125, the nozzle needle 110 is forced in the direction of the tip 145 of the lower part 20 of the injector 15, such that the injector 15 is closed and the fuel injection into the combustion chamber is ended.

To prevent seizing of the control piston 70 in the control piston bore 65 of the control plate 60, the control piston 70 has, at the circumference, a gap 150 arranged between the control piston 70 and the control piston bore 65. The gap 150 itself has a gap width b. If, as already discussed above, the control piston 70 is forced in the direction of the nozzle needle by the leakage pin 100, fuel flows out of the spring chamber 85 via the gap 150 into the first control chamber 80. This leads to pressure equalization between the spring chamber 85 and the first control chamber 80.

The volume flow of the fuel flowing through the gap 150 is dependent on the viscosity of the fuel. Here, as shown in FIG. 4, the fuel has a kinetic viscosity cSt which decreases sharply with increasing temperature. Normally, the fuel, in particular the diesel fuel, may have a temperature of $^{-3}0°$ C. to 100° C. This has the effect that, in the case of a uniform gap width b of the gap 150, the leakage losses through the gap 150 increase with increasing temperature T.

The spring force exerted on the control piston 70 by the control piston spring 90 ensures that, in the closed state of the injector 15, the control piston 70 bears against the leakage pin 100. In this way, the actuator 50, the leakage pin 100 and the control piston 70 are coupled to one another without clearance.

The leakage pin 100 together with the leakage pin bore 105 realizes a first pairing clearance 155. The first pairing clearance 155 is in this case selected such that a second gap (not illustrated) is provided at the circumference between the leakage pin 100 and the leakage pin bore 105, and a first leakage 160 from the first control chamber 80 in the direction of the actuator chamber 45 can take place between the leakage pin bore 105 and the leakage pin 100. From the actuator chamber 45, the first leakage 160 can escape from the injector 15 via a leakage port 165.

Through the gap 150 between the control piston 70 and the control piston bore 65, if the pressure in the first control chamber 80 is lower than the pressure in the spring chamber 85, a second leakage 70 takes place from the spring chamber 85 into the control chamber 80 along the control piston 70 through the gap 150.

Furthermore, the control piston 70 may have a throttle bore 75 which fluidically connects the spring chamber 85 to the first control chamber 80. In this case, a third leakage 180 takes place through from the spring chamber 85 into the first control chamber 80 through the throttle bore 175.

The nozzle needle 110 is guided in the nozzle needle sleeve 115 by way of a second pairing clearance 185. The second pairing clearance 185 is in this case selected such that a second gap (not illustrated) is provided, on the circumference, between the nozzle needle 110 and the nozzle needle sleeve 115. By way of the second pairing clearance 185, it is possible, if the pressure in the second control chamber 125 is lower than the pressure in the high-pressure region 40, for a fourth leakage 190 from the high-pressure region 40 into the second control chamber 125 to take place.

In the closed state of the injector 15, the first leakage 160 along the leakage pin 100 gives rise to an outflow of fuel out of the first control chamber 80. To prevent a pressure drop in the first control chamber 80, which can lead to an inadvertent opening of the nozzle needle 110, the fuel flowing out as a result of the first leakage 160 must be compensated by way of the second leakage 170, the third leakage 180 and/or the fourth leakage 190. If the throttle bore 117 is not provided, the third leakage 180 is omitted, such that the sum of the second leakage 170 and the fourth leakage 190 is at least as great as the first leakage 160. If the throttle bore 175 is provided, the sum of the second leakage 170, the third leakage 180 and the fourth leakage 190 is at least as great as the first leakage 160.

In the open state of the nozzle needle 110 and thus of the injector 15, the second leakage 170, the third leakage 180 and/or the fourth leakage 190 give rise to an inflow of fuel into the first control chamber 80 and into the second control chamber 125. The inflow of fuel causes a pressure increase in the first control chamber 80 and in the second control chamber 125. Here, to prevent inadvertent premature closure of the nozzle needle 110 and thus of the injector 15, it must be ensured that the increase in pressure in the first control chamber 80 and in the second control chamber 125 is kept small.

Furthermore, the second leakage 170 and the fourth leakage 190 must be selected such that an inadvertent opening of the nozzle needle 110 in the event of very steep pressure rises in the high-pressure region 40 is prevented. As already discussed above and shown in FIG. 4, the fuel has a viscosity which changes with temperature. In configuring the gap width b of the gap 150 of the control piston 70, but also of the pairing clearances 155, 185, it must be ensured that the control piston 70 does not become jammed in the control piston bore 65, giving rise to seizing of the control piston 70 in the control piston bore 65, in the presence of high temperatures of the fuel. At the same time, it must be ensured that the second leakage 170 through the gap 150 is adequately great.

This likewise applies analogously to the leakage pin 100 in the leakage pin bore 105 and the first leakage 160, and to the fourth leakage between the nozzle needle sleeve 115 and the nozzle needle 110.

To influence the leakages 160, 170, 180, 190 in targeted, temperature-dependent fashion, it is provided in the embodiment that, by way of example, the control piston 70 has a first material, and the control piston plate 60 has a second material.

The first material, when warmed up, exhibits first thermal expansion. The second material, when warmed up, exhibits second thermal expansion. The second thermal expansion differs from the first thermal expansion. Here, the first material and the second material are selected such that, when the control plate 60 and the control piston 70 are warmed up, the gap width b of the gap 150 decreases in order to limit the second leakage 170 between the spring chamber 85 and the first control chamber 80 with increasing temperature T of the fuel.

It is pointed out that the leakage pin 100 and the leakage pin plate 106, in which the leakage pin bore 105 is arranged, likewise have a material combination of said type. The same also applies to the nozzle needle sleeve 115 and the nozzle needle 110, wherein the nozzle needle 115 has the second material and the nozzle needle 110 has the first material. In this way, it is also possible for the first leakage 160 at the leakage pin 100, and/or the fourth leakage 190 between the nozzle needle sleeve 115 and the nozzle needle 110, to be reduced by way of an expansion of the material of the nozzle needle 110 and/or of the leakage pin 100 when the nozzle needle 110 and/or the leakage pin 100 are warmed up, as the pairing clearances 155, 185 between the leakage pin 100 and the leakage pin bore 105 and between the nozzle needle 110 and the nozzle needle sleeve 115 become smaller with progressive warming-up, and the gaps present in each case between leakage pin 100 and leakage pin bore 105 and between nozzle needle 110 and nozzle needle sleeve 115 become narrower.

Here, the materials may be selected such that, when the control plate 60 and/or the control piston 70 are/is warmed up, the second leakage 170 through the gap 150 is substantially constant over the course of the warming-up of the control plate 60 and/or of the control piston 70. Also, in the embodiment, the materials of the nozzle needle 110, nozzle needle sleeve 115, leakage pin 100 and leakage pin plate 106 are selected analogously to the control piston 70 and the control plate 60. In this way, particularly good control characteristics of the injector 15 can be attained; in particular, an undesired opening or closing of the nozzle needle 110 can be avoided.

The first material has a first coefficient of thermal expansion, and the second material has a second coefficient of thermal expansion. Here, the materials of the control piston 70 and/or of the control plate 60 are selected such that the first coefficient of thermal expansion is lower than the second coefficient of thermal expansion. In particular if the first material has hard metal, in particular in a composition with at least 70, preferably 90 percent tungsten carbide and 1 to 30 percent, preferably 1 to 10, cobalt, and if the second material is steel, in particular an unalloyed or low-alloy steel, it is possible in this way for the operating characteristics of the injector 15 to be kept uniform over the course of the warming-up of the injector 15.

As an alternative to the above-stated fraction of the cobalt of the first material, this may be replaced with a nickel-chromium fraction or a nickel-chromium-cobalt fraction, such that the first material has at least 70 percent, preferably 90 percent tungsten carbide and 1 to 30 percent, preferably 1 to 10 percent nickel-chromium or nickel-chromium-cobalt.

By virtue of the fact that the control plate 60 is composed of steel, it exhibits similar warming-up characteristics to the injector housing 25. At the same time, the gap 150 is reduced in terms of its gap width b by the control piston 70 composed of hard metal when the latter is warmed up.

Even though the invention has been illustrated and described in more detail on the basis of the preferred exemplary embodiment, the invention is not restricted to the examples disclosed, and other variations may be derived therefrom by a person skilled in the art without departing from the scope of protection of the invention.

It is emphasized that, as an alternative to the configuration of the injector 15 described above, it is also the case that only one or two of the three combinations of piston guide (control plate 60, leakage pin plate 106, nozzle needle 110) and piston (control piston 70, leakage pin 100, nozzle needle sleeve 115) has the above-stated material combination. What is particularly simple to implement is the configuration in which only the control piston 70 has the first material and the control piston plate 60 has the second material in order to limit the second leakage 170 between the spring chamber 85 and the first control chamber 80.

As an alternative to the materials stated immediately above, it is also conceivable for materials other than those stated immediately above to be used for the control piston 70 and the control plate 60 and/or for the leakage pin plate 106 and the leakage pin 100 and/or for the nozzle needle sleeve 115 and for the nozzle needle 110. Here, it is particularly advantageous if the materials are selected such that the two materials have, in terms of coefficient of thermal expansion, a difference of 3 to $10 \cdot 10^{-6}$ $K^{-1}$, in particular 5 to $10 \cdot 10^{-6}$ $K^{-1}$.

Here, it is particularly advantageous if the first coefficient of thermal expansion of the first material is 5 to $25 \cdot 10^{-6}$ $K^{-1}$ and the second coefficient of thermal expansion of the second material is 10 to $30 \cdot 10^{-6}$ $K^{-1}$.

As an alternative to the above-stated material combination of hard metal and steel, a material combination of titanium is conceivable, in particular if the first material has 50 percent, preferably 80 percent titanium and the other material is steel. Here, it is advantageous for the steel to comprise at least one of the following metals: chromium, nickel, manganese, copper.

It is alternatively also conceivable for a material combination for the first material and the second material to be selected, in the case of which at least one of the two materials has steel with a coefficient of thermal expansion of 12 to $10 \cdot 10^{-6}$ $K^{-1}$ and the other of the two materials has a manganese steel. Here, it is particularly advantageous if the manganese steel is MnNi10Cu18 or MnNi16Cu10.

It is pointed out that the stated material combinations of first material and second material are suitable both for the control plate 60 and the control piston 70 but also for the leakage pin 100 and the leakage pin plate 106 and/or for the nozzle needle sleeve 115 and the nozzle needle 110.

It is also conceivable for the above-stated material combinations to be combined with one another.

What is claimed is:

1. An injector comprising:

an actuator chamber, an actuator arranged in the actuator chamber, a piston guide having a bore, a piston arranged in the bore of the piston guide, a first face side of the piston facing toward the actuator, wherein the first face side delimits a first chamber arranged in the bore, a second face side of the piston located opposite the first chamber, wherein the second face side delimits a second chamber in the bore, a high-pressure bore extending from the second chamber of the bore to a high-pressure region, and a nozzle needle disposed in the high-pressure region for controlling a flow of fuel from the injector into an internal combustion engine, wherein the nozzle needle and the piston are hydraulically coupled through the high-pressure bore but without a mechanical linking member, wherein the piston is arranged between the first chamber and the second chamber, and a lengthening of the actuator moves the piston away from the actuator, increasing a volume of the first chamber and reducing a volume of the second chamber, wherein a gap extends around a circumference between the piston and the bore, the gap having a gap width allowing fuel to flow between the first chamber and the second chamber, wherein the piston includes a first material and the piston guide includes a second material, wherein the first material, when heated, exhibits a first thermal expansion rate, and the second material, when heated, exhibits a second thermal expansion rate that differs from the first thermal expansion rate, and wherein the first material is selected relative to the second material such that, as a temperature of the piston guide and the piston increases, the gap width decreases as a result of the differing thermal expansion rates to thereby limit fuel flow between the first chamber and the second chamber.

2. The injector of claim 1, wherein the first material and the second material are selected such that, when the at least one of the piston guide or the piston is heated, leakage of the fuel through the gap is substantially constant during the heating of the at least one of the piston guide or the piston.

3. The injector of claim 1, wherein the first material has a lower coefficient of thermal expansion than the second material.

4. The injector of claim 1, wherein the first material has a first coefficient of thermal expansion and the second material has a second coefficient of thermal expansion, wherein the first and second coefficients of thermal expansion have a difference of 3 to 12·10−6 K−1, in particular 5 to 10·10−6 K−1.

5. The injector of claim 1, wherein the first material has a first coefficient of thermal expansion of 5 to 25·10−6 K−1 and the second material has a second coefficient of thermal expansion of 10 to 30·10−6 K−1.

6. The injector of claim 1, wherein:

one of the first and second materials comprises a composition having at least 70 percent tungsten carbide and 1 to 30 percent cobalt or nickel-chromium or nickel-chromium-cobalt, and the other of the first and second materials comprises an unalloyed steel or low-alloy steel.

7. The injector of claim 1, wherein:

one of the first and second materials comprises at least 50 percent titanium, and the other of the first and second materials comprises a steel including at least one of chromium, nickel, manganese, or copper.

8. The injector of claim 1, wherein:

one of the first and second materials comprises steel with having a coefficient of thermal expansion of 12 to 16·10−6 K−1, and the other of the first and second materials comprises a manganese steel selected from the group consisting of MnNi10Cu18 and MnNi16Cu10.

9. The injector of claim 1, wherein:

the piston guide is a control plate or a leakage pin bore, and the piston is a control piston or a leakage pin.

10. The injector of claim 1, wherein the actuator chamber is a piezo actuator.

11. A fuel injection system comprising:

a common rail configured to carry fuel, and a plurality of fuel injectors connected to the common rail, each fuel injector comprising:

an actuator chamber, an actuator arranged in the actuator chamber, a piston guide having a bore, a piston arranged in the bore of the piston guide, a first face side of the piston facing toward the actuator, wherein the first face side delimits a first chamber arranged in the bore, a second face side of the piston located opposite the first chamber, wherein the second face side delimits a second chamber in the bore, a high-pressure bore extending from the bore to a high-pressure region, and a nozzle needle disposed in the high-pressure region for controlling a flow of fuel from the injector into an internal combustion engine, wherein the nozzle needle and the piston are hydraulically coupled through the high-pressure bore but without a mechanical linking member, wherein the piston is arranged between the first chamber and the second chamber, and a lengthening of the actuator moves the piston away from the actuator, increasing a volume of the first chamber and reducing a volume of the second chamber, wherein a gap extends around a circumference between the piston and the bore, the gap having a gap width allowing fuel to flow between the first chamber and the second chamber, wherein the piston includes a first material and the piston guide includes a second material, wherein the first material, when heated, exhibits a first thermal expansion rate, and the second material, when heated, exhibits a second thermal expansion rate that differs from the first thermal expansion, and wherein the first material is selected relative to the second material such that, as a temperature of the piston guide and the piston increases, the gap width decreases as a result of the differing thermal expansion rates to thereby limit fuel leakage between the first chamber and the second chamber.

12. The fuel injection system of claim 11, wherein the first material and the second material are selected such that, when the at least one of the piston guide or the piston is heated, leakage of the fuel through the gap is substantially constant during the heating of the at least one of the piston guide or the piston.

13. The fuel injection system of claim 11, wherein the first material has a lower coefficient of thermal expansion than the second material.

14. The fuel injection system of claim 11, wherein the first material has a first coefficient of thermal expansion and the second material has a second coefficient of thermal expansion, wherein the first and second coefficients of thermal expansion have a difference of 3 to $12 \cdot 10^{-6}$ $K^{-1}$, in particular 5 to $10 \cdot 10^{-6}$ $K^{-1}$.

15. The fuel injection system of claim 11, wherein the first material has a first coefficient of thermal expansion of 5 to $25 \cdot 10^{-6}$ $K^{-1}$ and the second material has a second coefficient of thermal expansion of 10 to $30 \cdot 10^{-6}$ $K^{-1}$.

16. The fuel injection system of claim 11, wherein:

one of the first and second materials comprises a composition having at least 70 percent tungsten carbide and 1 to 30 percent cobalt or nickel-chromium or nickel-chromium-cobalt, and the other of the first and second materials comprises an unalloyed steel or low-alloy steel.

17. The fuel injection system of claim 11, wherein:

one of the first and second materials comprises at least 50 percent titanium, and the other of the first and second materials comprises a steel including at least one of chromium, nickel, manganese, or copper.

18. The fuel injection system of claim 11, wherein:

one of the first and second materials comprises steel with having a coefficient of thermal expansion of 12 to $16 \cdot 10^{-6}$ $K^{-1}$, and the other of the first and second materials comprises a manganese steel selected from the group consisting of MnNi10Cu18 and MnNi16Cu10.

19. The fuel injection system of claim 11, wherein:

the piston guide is a control plate or a leakage pin bore, and the piston is a control piston or a leakage pin.

20. The fuel injection system of claim 11, wherein the actuator chamber is a piezo actuator.

* * * * *